US006656014B2

(12) United States Patent
Aulson

(10) Patent No.: US 6,656,014 B2
(45) Date of Patent: Dec. 2, 2003

(54) MOBILE BRIDGE CUTTING ARRANGEMENT

(76) Inventor: Alan P. Aulson, 201 Pond St., Georgetown, MA (US) 01833

( * ) Notice: Subject to any disclaimer, the term of this patent is extended or adjusted under 35 U.S.C. 154(b) by 50 days.

(21) Appl. No.: 09/804,115

(22) Filed: Mar. 12, 2001

(65) Prior Publication Data

US 2002/0124700 A1 Sep. 12, 2002

(51) Int. Cl.[7] ..... B24C 3/06

(52) U.S. Cl. ..... 451/2; 451/5; 451/8; 451/92; 83/177; 83/928

(58) Field of Search ..... 83/177, 928, DIG. 2, 83/53; 299/39.3, 17; 125/35; 269/1, 2; 901/1, 41; 451/91, 92, 99, 2, 5, 8

(56) References Cited

U.S. PATENT DOCUMENTS 4,718,201 A * 1/1988 Legge ..... 83/54
4,795,217 A * 1/1989 Hilaris ..... 299/17
5,003,729 A * 4/1991 Sherby ..... 83/177
5,010,694 A * 4/1991 Agbede ..... 451/92
5,655,426 A * 8/1997 DeJohn ..... 83/177
5,676,125 A * 10/1997 Kelly et al. ..... 83/928
5,695,255 A * 12/1997 LeBlond ..... 299/39.1
5,979,518 A * 11/1999 Hamby ..... 83/928
6,049,580 A * 4/2000 Bodin et al. ..... 299/17
6,286,905 B1 * 9/2001 Kimura et al. ..... 299/39.3

* cited by examiner

*Primary Examiner*—Stephen Choi
(74) *Attorney, Agent, or Firm*—Don Halgren

(57) ABSTRACT

A mobile articulable cutter apparatus for the cutting and dismemberment of a building structure to permit the environmentally safe removal of such structure from a building site. The apparatus comprises a mobile base support having an articulable lift arm extending therefrom. The arm has a distal end thereon. A guidable cutter head is arranged on the distal end of the lift arm. A fluid jet is nozzle arranged in the cutter head. A pressurizable fluid source is arranged in fluid controlled communication with the nozzle. The nozzle is arranged to be in closely positioned guided travel adjacent the surface of the structure to be cut by a jet of fluid under pressure from the nozzle. The cutter head and nozzle is readily movable to a further cut location by the mobile base support after an initial segment of the structure has been removed

8 Claims, 3 Drawing Sheets

MOBILE BRIDGE CUTTING ARRANGEMENT

BACKGROUND OF THE INVENTION

1. Field of the Invention

This invention relates to material cutting apparatus, and more particularly to mobile water jet arrangements for cutting up rigid structures such as for example, buildings, bridges and roadways and hazardous material structures at their site.

2. Prior Art

Dismantling of bridges and roadways is an expensive, time consuming, dangerous and environmentally hazardous procedure. Structures such as buildings, bridges and the like are often overbuilt to withstand tremor, aging and misuse, which provides difficulties to contractors when those structures are to be torn down and removed from the site.

Overpasses and bridge superstructure typically are removed with knockdown cranes, gas torches which are utilized to cut the steel columns and supporting girders, and manually operated jackhammers, to remove the road surface. Often this structural steel has to be de-leaded or de-painted so as not to contaminate the environment during the cutting operation. Noise, hazardous fumes, dust and environmental contaminants are often the byproduct of this operation.

An advance in the cutting of material is made by a water jet cutting arrangement known as the Bug-o™ System. This arrangement utilizes a high pressure jet of water to cut through the structural material. However this system also requires a rigid rail or track to be placed directly onto the structure to be cut, this track formed to attach and closely follow all the contours and surface curves of the material to be cut. A carriage which holds a water jet nozzle engages and travels on the track over this circuitous course and cuts the material to which the track is attached, as the jet supporting carriage travels over this fixed path. Such a track may be difficult to apply and dangerous depending upon the height and location of the structure being cut, and of course its direction and guidance is not readily changeable.

It is an object of the present invention to overcome the disadvantages of the prior art.

It is a further object of the present invention to provide a novel material cutting arrangement which minimizes the hazards to the environment as well as to the operators of the cutting system, and permit hazardous structures to be safely dismantled in a manner not taught in the art.

It is yet a further object of the present invention, to provide a cutting arrangement which is readily adapted to any structural element being torn down, in a most efficient manner without attached jigs or track networks.

It is yet a still further object of the present invention to provide a material cutting arrangement which is efficient, readily adaptable by wheeled mobility to any structural site and readily movable to subsequent locations with minimal effort and cost.

BRIEF SUMMARY OF THE INVENTION

The present invention comprises a mobile arrangement for cutting buildings and structures and the like apart. This mobile arrangement permits structures such as I-beams, pipes, tanks, girders and road surfaces of bridges to be dismantled in large sections in a clean and efficient manner. It is also particularly suited for hazardous work such as chemical plants, asbestos and concrete assemblies where manipulable robotics is ideal. The mobile cutting arrangement of the present invention comprises a mobile base support such as an operator driven wheeled crane or front-end loader having independent motorized propulsion, and a movable arm articulable with respect to the mobile base support. The movable arm has a distal end which supports a cutter platform. The cutter platform includes a controllable robotic base with a movable first arm thereon. The movable first arm has a distal end to which is attached a movable and controllable second arm.

The second arm has a distal end with a cutting head thereon. The cutting head is articulable with respect to the distal end of the second arm. The cutting head includes a water jet nozzle that is fed high pressure fluid from a high pressure fluid pump via a flexible conduit arranged therebetween. The pressurized fluid is ejected through the cutting nozzle in the head, at a pressure of between thirty thousand psi to sixty thousand psi.

The mobile arm platform may be stabilized by at least one stabilizing arm to assist in minimizing any irregular movement of the cutting nozzle head on the distal end of the furthermost or second arm.

The stabilizing members in one embodiment may be attached to the structural component being cut, or alternatively the stabilizing members may be resting on a ground support close to the structure being cut.

The stabilizing arms may be attached as the first embodiment, to the structure being cut, by a clamping arrangement or by magnetic attachment thereto.

The robotic first and second arms and the articulable nozzle carrying the water jet for cutting the structural material, may in one preferred embodiment be controlled by a pre-programmed controlled system by which the cutting nozzle has been pre-guided along the path of the material to be cut, which path is then placed within the memory of the control system and activated upon the initiation of the disposition of the cutting head against the structural material to be cut, automatically guiding the first and second arms and cutting head supporting the water jet nozzle.

In a further preferred embodiment of the present invention, the articulable cutting nozzle head and first and second arms of the robotic carrier may be guided over a desired cutting path by an operator within the mobile base support.

A camera may be arranged on the first or second arm such as at the upper end of the juncture between the first and second robotic arms, which camera is controlled through a circuit through a monitor within the cab of the mobile base support in a further embodiment. The monitor within the cab of the mobile base support would permit the operator therein to guide the nozzle in the cutting head along the desired path set by the operator without the necessity of pre-programming that path within a memory circuit of a control system.

A further embodiment of the present invention includes a control finger arrangement adapted to the cutting nozzle head wherein angular displacement of a sensor on the distal end of the control finger sends a signal through a proper circuit back to a computer controlling the robotic arms on the platform, to move the articulable cutting nozzle head accordingly, so as to effect a motion of the cutting nozzle jet perpendicular to the material being cut and following its path parallel and adjacent the surface.

Thus what has been shown is a unique arrangement for rapidly and economically cutting structural material in places where it would be difficult for workers to otherwise manipulate a torch or cutting jet onto a structure. The mobility and securability of this cutting nozzle head permits almost any material such as a concrete wall, road bed, hazardous chemical plant piping or structural steel to be severed and removed without endangering the environment or endangering personnel having to actually climb on and work on that structural material being cut.

The invention thus comprises a mobile articulable cutter apparatus for the cutting and dismemberment of a building or rigid structure to permit the environmentally safe removal of such structure from a building site comprising a mobile base support having an articulable lift arm extending therefrom, the arm having a distal end thereon, a guidable cutter head arranged on the lift arm, and a fluid jet nozzle arranged in the cutter head, with a pressurizable fluid source in fluid controlled communication with the nozzle. The nozzle is arranged to be in closely positioned guided travel adjacent the surface of the structure to be cut by a jet of fluid under pressure from the nozzle, the mobile base support being readily movable to a further cut location by the mobile base support after an initial segment of the structure has been removed. A further articulable arm may be arranged between the lift arm and the cutter head to permit extended relative motion therebetween. The base support may have an operator thereon and a set of motorized wheels for its mobility over land. The cutter head has a stabilizer arrangement arranged therewith to minimize irregular cutting of the building structure by the cutter apparatus. The stabilizer arrangement for the cutter head may comprise at least one stabilizing arm extending between an end portion of the lift arm and the building structure. The stabilizer arrangement for the cutter head may comprise at least one stabilizing arm extending between an end portion of the lift arm and a ground base adjacent the building structure. The stabilizer arrangement for the stabilizing arm extending from an end portion of the lift arm may be attached to the building structure by a mechanical clamp mechanism. The stabilizer arrangement for the stabilizing arm extending from an end portion of the lift arm may be is attached to the building structure by an electromagnetic clamp mechanism. The cutter head supporting the nozzle may be guided by a pre-programmed control device arranged to move the cutter head and nozzle adjacent to the building structure to be cut, thereby controlling the path of the cut of the building structure. The cutter head supporting the nozzle may be guided by a pre-programmed control device arranged to move the cutter head and nozzle adjacent to the building structure to be cut, thereby controlling the path of the cut of the building structure. The cutter head supporting the nozzle may be guided by an electronic camera arranged in communication with a monitor in a cab of the base support to permit an operator to move the cutter head and nozzle adjacent to the building structure to be cut, whereby the operator controls the path of the cut of the building structure through the camera. The cutter head supporting the nozzle may be guided by a displacement sensitive finger sensor control device arranged adjacent the cutter head to control movement of the cutter head and nozzle adjacent to the building structure to be cut, thereby controlling the path of the cut of the building structure. The pressurizable fluid may include an abrasive material fed therewith, to assist in the cutting of the structure.

The invention also includes a method of cutting a building or rigid structure into smaller pieces for the environmentally safe deconstruction thereof comprising the steps of: arranging a high pressure fluid jet nozzle on a distal end of an articulable arm of a mobile overland base unit, moving the mobile overland base unit and the fluid jet nozzle into relatively close proximity with the building structure, supplying high pressure fluid through the nozzle and against the building structure, and guiding the nozzle over a path adjacent the building structure to permit the building structure to be cut along the path as controlled by the articulable arm. The method may also include the steps of: pre-programming said path of cut into a control computer by instructing the cutter head and computer as to a proper path, so as to permit the nozzle to be guided on the path of cutting thereby, arranging an electronic camera on the articulable arm and in electronic communication with a control monitor controlled by an operator within the overland base unit to permit the cutting head and nozzle to be guided over the building structure thereby as it jets fluid thereagainst and cuts the building structure, stabilizing the cutter head and the nozzle against undesired movement by arranging a stabilizing arm between the articulable arm and the building structure being deconstructed, and/or stabilizing the cutter head and the nozzle by arranging a stabilizing arm between the articulable arm and a ground base adjacent the building structure being deconstructed.

BRIEF DESCRIPTION OF THE DRAWINGS

The objects and advantages of the present invention will become more apparent when viewed in conjunction with the following drawings in which.

DETAILED DESCRIPTION OF THE PREFERRED EMBODIMENTS

Figure 1:
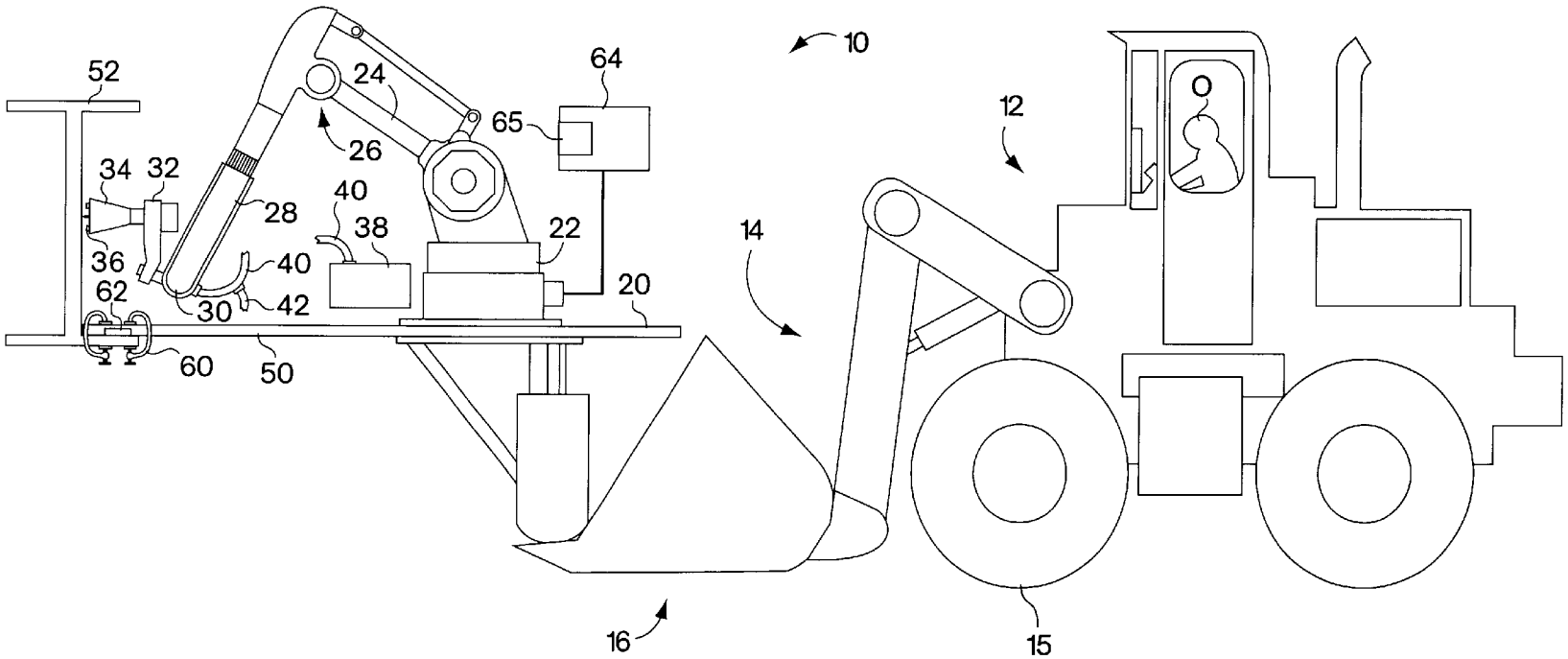
FIG. 1 is a side elevational view of the mobile cutter arrangement constructed according to a first embodiment thereof.

Referring to the drawings in detail, and particularly to FIG. 1, there is shown the present invention which comprises a mobile cutter arrangement 10 for cutting buildings and hazardous and rigid structures into smaller sections or components for easy dismantling. This mobile cutter arrangement 10 permits structures such as I-beams, girders and road surfaces of bridges to be dismantled in large sections in a clean and efficient manner. The mobile cutting arrangement 10 of the present invention comprises a mobile base support 12 such as a crane or front-end loader having independent motorized propulsion, for maneuverable overland movement on wheels 15 or the like. This permits the mobile cutting arrangement 10 to be readily adjusted at the site location according to the short term needs of the debris removal crew. A movable lift arm 14 is preferably controllably arranged on an operator end of the mobile base support 12. The movable lift arm 14 has a distal end 16 which supports a movably positionable cutter platform 20. The cutter platform 20 includes a controllable robotic base 22 with a movable first arm 24 thereon. The movable first arm 24 has a distal end 26 to which is attached a movable and controllable second arm 28.

The second arm 28 has a distal end 30 with a cutting head 32 thereon. The cutting head 32 is controllably articulable with respect to the distal end 30 of the second arm 28. The cutting head 32 includes a water jet nozzle 34 that is fed high pressure fluid 36 from an operator and computer controlled high pressure fluid pump 38 via a flexible conduit 40 arranged therebetween. The pressurized fluid 36 is ejected through the cutting nozzle 34 in the head 32, at a pressure of between thirty thousand psi to sixty thousand psi. A secondary feed 42 may an abrasive or grit material to the jet nozzle 34 to assist with the fluid (water) jet cutting operation.

The mobile positional cutter platform 20 may be stabilized by at least one stabilizing arm 50 to assist in minimizing any irregular or vibratory movement of the cutting nozzle head 32 on the typically elongatedly extended distalmost end 30 of the second arm 28.

Figure 2:
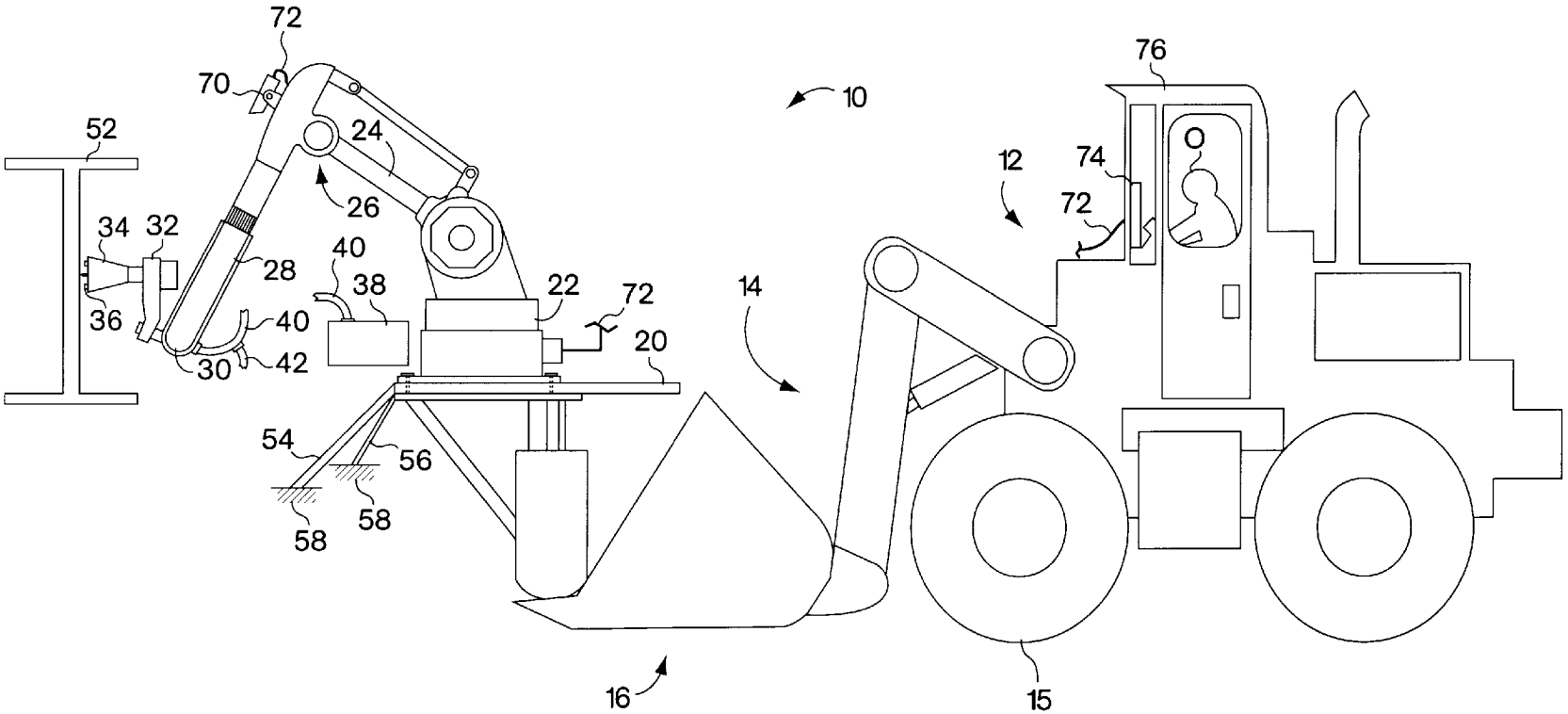
FIG. 2 is a side elevational view similar to FIG. 1, with the cutter stabilizing components arranged in a further embodiment.
Figure 3:
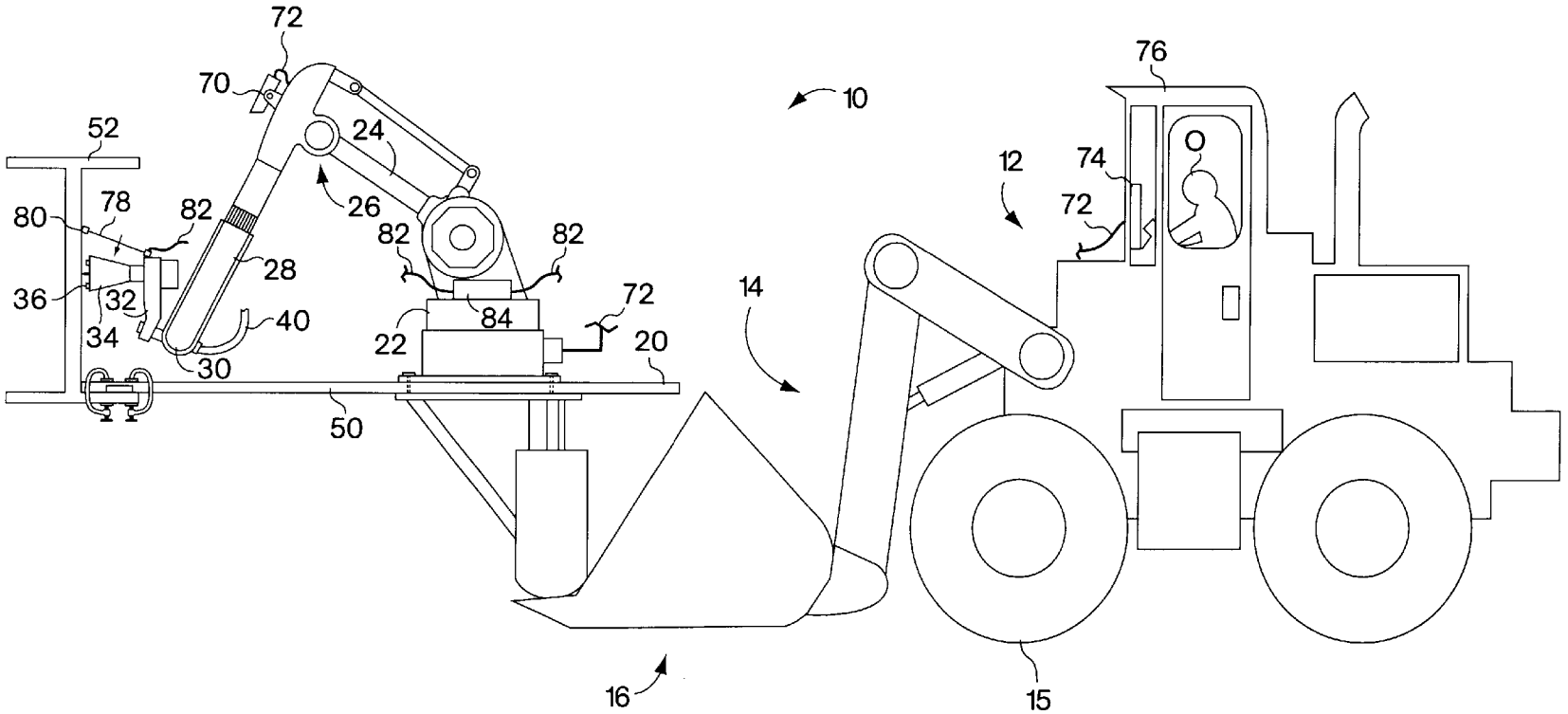
FIG. 3 is a view similar to FIG. 1 disclosing a tracing guide apparatus for guiding the cutting nozzle head along a path of structural material.

The stabilizing members 50 in one preferred embodiment, as shown in FIG. 1, may be attached to the structural component such as the "I" beam 52 shown being cut. Alternatively, one or more stabilizing member 54 and 56 may be resting on a ground support 58 close to the structure (the "I" beam 52) being cut, as is represented in FIG. 2.

The stabilizing arms 50, as shown in FIG. 1, may be attached as the first embodiment, to the I beam structure 50 being cut, by a readily realeasable or position-adjustable mechanical or hydraulically powered clamping arrangement 60 or by an electromagnetic clamp 62 arrangement.

The robotic first and second arms 24 and 28 and the articulable head 32 carrying the water jet nozzle 34 for cutting the structural material 52, may in one embodiment be controlled by a pre-programmed or programmable controlled system 64 by which the cutting nozzle 34 has been pre-guided along the path against the surface material 52 to be cut, which path is then placed within the memory 65 of the control system 64 and activated upon the initiation of the disposition of the cutting head 32 against the structural material 52 to be cut, by the equipment operator "O". This automatically controls and guides the motion of the first and second arms 24 and 28 and actuates the cutting head 32 supporting the water jet nozzle 34 on the I beam 52.

In a further preferred embodiment of the mobile cutter arrangement 10, the articulable cutting head 34 and first and second arms 24 and 28 of the robotic carrier base 22 may be guided over a desired cutting path by an operator "O" within the mobile base support.

An electronic camera 70, in a further embodiment, may be arranged on the first or second arm 24 or 28, such as for example, at the upper end of the juncture 26 between the first and second robotic arms 24 and 28, as may be seen in FIG. 2. The electronic camera 70 may be controlled through a circuit 72 communicating with a monitor 74 within the cab 76 of the mobile base support 12, as represented in FIG. 2. The monitor 74 within the cab 76 of the mobile base support 12 would permit the operator "O" therein to guide the nozzle 34 in the cutting head 32 along the desired path set by the operator "O" without the necessity of pre-programming that path within a memory circuit of a control system.

A yet further preferred embodiment of the mobile cutter arrangement 10 includes a control finger arrangement 78 which is arranged on the cutting nozzle head 32 wherein motion thereof and contact with the I beam 52 by an electronic contact and displacement sensor 80 on the distal end of the control finger sends a signal through a proper circuit 82 back to a computer 84 controlling the robotic arms 24 and 28 on the base platform 20, to move the articulable cutting nozzle head 34 accordingly, so as to thereby effect a proper motion of the cutting nozzle jet 36 perpendicular to the material 52 being cut and following its path parallel and adjacent the surface.

Thus what has been shown is a unique arrangement for rapidly and economically cutting structural material in places where it would be difficult for workers to otherwise manipulate at will, a torch or cutting jet onto a structure. The ready "real-time" adaptable mobility and securability of the different embodiments of water jet cutting nozzle head arrangement permits almost any material such as a road bed, building or structural steel, or hazardous pipe or chemical plant to be severed and removed without endangering the environment or endangering personnel having to actually climb on and work on that structural material being cut.

I claim:

1. A mobile articulable cutter apparatus for the cutting and dismemberment of a rigid metal or concrete building structure to permit the environmentally safe removal of such structure from a building site comprising:

a mobile base support having an articulable lift arm extending therefrom, said arm having a distal end thereon;

a guidable cutter head arranged on said lift arm; and a position-adjustable fluid jet nozzle arranged in said cutter head, with a pressurizable fluid source in fluid controlled communication with said nozzle, said nozzle arranged to be in closely positioned guided travel adjacent the surface of said structure to be cut by a jet of fluid under pressure from said nozzle, said mobile base support being readily movable to a further cut location by said mobile base support after an initial segment of said structure has been removed, wherein said cutter head has a cutter stabilizer arrangement arranged therewith to minimize irregular cutting of said building structure by said cutter apparatus, said cutter stabilizer arrangement comprising at least one stabilizing arm arranged between said distal end of said arm, which said stabilizing arm is connectively secured to said building structure by a clamp mechanism.

2. The mobile articulable cutter apparatus as recited in claim 1, wherein a further articulable arm is arranged between said lift arm and said cutter head to permit extended relative motion therebetween.

3. The mobile articulable cutter apparatus as recited in claim 1, wherein said clamping mechanism comprising an electromagnetic clamp mechanism.

4. The mobile articulable cutter apparatus as recited in claim 1, wherein said cutter head supporting said nozzle is guided by a pre-programmed control device arranged to move said cutter head and nozzle adjacent to said building structure to be cut, thereby controlling the path of said cut of said building structure.

5. The mobile articulable cutter apparatus as recited in claim 1, wherein said cutter head supporting said nozzle is guided by an electronic camera arranged in communication with a monitor in a cab of said base support to permit an operator to move said cutter head and nozzle adjacent to said building structure to be cut, whereby the operator controls the path of said cut of said building structure through said camera.

6. The mobile articulable cutter apparatus as recited in claim 1, wherein said cutter head supporting said nozzle is guided by a displacement sensitive finger sensor control device arranged adjacent said cutter head to control movement of said cutter head and nozzle adjacent to said building structure to be cut, thereby controlling the path of said cut of said building structure.

7. The mobile cutter apparatus as recited in claim 1, wherein said pressurizable fluid includes an abrasive material fed therewith, to assist in the cutting of said structure.

8. A mobile articulable cutter apparatus for the cutting and dismemberment of a building structure to permit the environmentally safe removal of such structure from a building site comprising:

a mobile base support having an articulable lift arm extending therefrom, said arm having a distal end thereon;

a guidable cutter head arranged on said lift arm;

a fluid jet nozzle arranged in said cutter head, with a pressurizable fluid source in fluid controlled communication with said nozzle, said nozzle arranged to be in closely positioned guided travel adjacent the surface of said structure to be cut by a jet of fluid under pressure from said nozzle, said mobile base support being readily movable to a further cut location by said mobile base support after an initial segment of said structure has been removed, wherein a further articulable arm is arranged between said lift arm and said cutter head to permit extended relative motion therebetween, wherein said base support has a set of motorized wheels for its mobility over land, wherein said cutter head has a stabilizer arrangement arranged therewith to minimize irregular cutting of said building structure by said cutter apparatus, wherein said stabilizer arrangement for said cutter head comprises at leas one stabilizing arm extending securely connected between said distal end of said lift arm and said building structure, wherein said stabilizer arrangement for said stabilizing arm extending from said distal end of said lift arm is attached to said building structure by a mechanical clamp mechanism, and wherein said cutter head supporting said nozzle is guided by a pre-programmed control device arranged to move said cutter head and nozzle adjacent to said building structure to be cut, thereby controlling the path of said cut of said building structure.

* * * * *